United States Patent [19]

Gaysert et al.

[11] 4,043,761

[45] Aug. 23, 1977

[54] CATALYTIC CONVERTER HAVING RESILIENT MONOLITH-MOUNTING MEANS

[75] Inventors: Gerhard Gaysert, Esslingen (Neckar); Walter Ottle, Faurndau, both of Germany

[73] Assignee: J. Eberspacher, Germany

[21] Appl. No.: 732,877

[22] Filed: Oct. 15, 1976

Related U.S. Application Data

[63] Continuation of Ser. No. 554,661, March 3, 1975, abandoned.

[51] Int. Cl.[2] ..... F01N 3/15; F01N 7/00

[52] U.S. Cl. ..... 23/288 FC

[58] Field of Search ..... 23/288 F, 288 FC; 60/299, 322; 181/36 B, 36 C, 47 R, 47 A, 47 B

[56] References Cited

U.S. PATENT DOCUMENTS

| | | | |
|---|---|---|---|
| 3,024,593 | 3/1962 | Houdry | 23/288 F |
| 3,692,497 | 9/1972 | Keith et al. | 23/288 FC |
| 3,798,006 | 3/1974 | Balluff | 23/288 FC |
| 3,854,888 | 12/1974 | Frietzsche et al. | 23/288 FC |
| 3,876,384 | 4/1975 | Santiago | 23/288 FC |
| 3,947,252 | 3/1976 | Musall et al. | 23/288 FC |
| 3,948,611 | 4/1976 | Stawsky | 23/288 FC |

*Primary Examiner*—Barry S. Richman
*Assistant Examiner*—Bradley Garris
*Attorney, Agent, or Firm*—McGlew and Tuttle

[57] ABSTRACT

A device for the catalytic purification of exhaust gases of internal combustion engines comprising a tubular metal housing having an exhaust gas supply connection at one end and an exhaust gas discharge connection at the opposite end and defining a gas flow passage therethrough. A tubular casing of sheet metal is disposed within the housing and spaced inwardly from the interior walls of the housing. In addition a substantially cylindrical monolithic catalyst carrier is disposed within the exhaust gas flow passage within the housing and is spaced radially inwardly from the metal casing and has axially extending passages therethrough for the flow of exhaust gases through it. A radially prestressed compacted metal mesh is disposed between the carrier and the casing and forms an elastic support for the carrier. An annular bearing member is disposed at each end of the housing and has an axially extending leg portion connected to a respective end of the tubular housing and to a respective end of the casing. In addition, the bearing member has a radially extending portion which forms an end abutment and an elastic seal ring is disposed between the end abutment and the end of the carrier. In addition a spring member having a substantially U-shaped cross section is oriented with the open U-shape bearing radially outwardly against the interior surface of the elastic seal ring.

5 Claims, 3 Drawing Figures

CATALYTIC CONVERTER HAVING RESILIENT MONOLITH-MOUNTING MEANS

This is a continuation of application Ser. No. 554,661 filed Mar. 3, 1975, now abandoned.

BACKGROUND OF THE INVENTION

1. Field of the Invention

This invention relates in general to the construction of exhaust gas treatment devices and in particular to a new and useful device for the catalytic purification of exhaust gases and to an improved structure therefor.

2. Description of the Prior Art

The present invention relates to a device for the catalytic purification of exhaust gases of internal combustion engines, in which the monolithic catalyzer is received in a housing. Such devices are already known. For example, a known construction includes an arrangement in which the catalyst body is provided with an external protective envelope of a fibrous aluminum silicate and supported, along with this protective envelope, on the inner surface of the housing, through an elastic, corrugated part. Frontally, in the flow direction, the catalyst body is retained by inwardly extending annular housing flanges. Another known arrangement is a device in which the catalyst body is received in a double-walled housing having elastic elements disposed between the two walls and is frontally fixed by rings made of a soft elastic, noncombustible material. Here, it is intended to support the catalyst body within a housing so as to enable it to withstand for a long time even extreme shock stresses due to the pulsation of the exhaust gas and to forces acting from the outside. In the known arrangements, the catalyst bodies have a relatively low mechanical resistance because of their thin-walled rib structure and are sensitive to stresses caused by rapidly varying temperatures. Now, the coefficient of thermal expansion of the conventional catalyst bodies is notably smaller than the coefficient of expansion of the supporting parts which are made of metal alloys such as Fe-Ni-Cr.

This means that at the high temperatures occurring during operation and being of the order of 850° C, relative deviations appear between the catalyst body and the supporting parts which, in the arrangements known up to date, are of the order of 1 mm. Howevr, under all operational circumstances, it must be insured that a force closure is continuously maintained between supports and catalyst body, i.e. the catalyst body must not move in its mounting. This requirement applies both to the axial and radial support. In some of the known solutions, rings of soft elastic materials are provided for compensating the unequal thermal expansions.

It has been found that the elastic deformation the rings can be credited with is very limited. The same problem, i.e. to insure an increased travel of the elastic system at the occurring temperatures and with economically acceptable expenses, arises at the use of other elastic mounting elements such as cup springs and metal bellows.

SUMMARY OF THE INVENTION

The present invention is directed to a construction such that the occurring relative motions of the catalyst body and the housing are limited to an extent insuring that the elastic rings have to absorb but relatively small elastic deformations.

In accordance with the invention, the catalyst body is surrounded by a metal casing, an elastic material is placed between the casing and the catalyst body, and the casing is supported on angle-shaped bearing members which are connected to the housing.

Thereby, it is obtained that the unequal thermal elongations of the catalyzer and the supporting casing surrounding the same have not to be fully absorbed by the elastic rings since the fixing forces acting on the catalyzer are brought about by the external housing wall. Consequently, the casing surrounding the catalyzer serves only to guide and radially hold the catalyzer.

According to a development of the invention, at least one of the angle-shaped bearing members is designed as a two-part member and an elastic element is provided between the two parts. This elastic element may be inserted into the divided bearing members, for example, in the form of single or two-wave sections of a corrugated tube or of a spring loop; or, in accordance with a further development of the invention, the angle-shaped bearing member itself may be elastic. Thus, for example, on its end facing the catalyst body, the bearing member may be cranked to an elastic leg. It is more favorable, however, as a rule, to provide a spring loop. Finally, it is possible, in accordance with the invention, to provide the housing itself with an elastic part absorbing the variations in length. Here again, sections of a corrugated tube are suitable which may be welded on or mounted between two flanges.

Due to the inventive device, the fixing forces acting on the catalyzer are provided by the external housing wall while the casing surrounding the catalyzer is used merely for centering and guiding the catalyst body. Further, according to a further development of the invention, an insulating material is placed in the annular space between the casing and the housing in order to reduce the longitudinal variations of the housing due to thermal expansion to an extent corresponding to the length variations of the catalyst body.

In a particularly advantageous embodiment of the invention, an elastic ring is provided between each of the bearing members and the catalyst body. This inventive arrangement of elastic rings has the advantage that any stressing in the longitudinal direction of the catalyst body can be absorbed by these elastic rings. Besides, the provision of such rings before the catalyzer is a well known measure which is used in the present invention advantageously only in connection with the bearing members. It has been found useful to have these rings, which may be made of a metal mesh, received in a seal ring having a U-shaped cross section. Thereby, it is obtained, in a simple and advantageous manner, that the portion of the exhaust gases which might flow past the catalyst body and, therefore, which are not subjected to the purification would be considerably reduced. If the arrangement is made very carefully, no exhaust gases will flow past the catalyst body with the result of a maximum purification effect.

To simplify the mounting of the inventive arrangement and, if desired, obtain an interchangeable mounting of the catalyst body, it is further provided to secure at least one of the bearing members to the housing. Due to this provision, the catalyst body along with its casing and the elastic layer therebetween can be inserted into the housing ready for reception and, thereupon, the other bearing member can be inserted. This bearing member may also be firmly connected to the housing, however, detachable variants are possible too.

To protect the catalyst body as well as the bearing members and, particularly, the housing from an exposure to the hot exhaust gas, according to a further development of the invention, a conkcally divergent inlet connection is provided before the catalyst body and a conically converging connection is provided after the catalyst body. These tapering connections have the advantage, in addition, that they permit a neat guiding of the exhaust gas into the catalyst body. At the same time, the widening contributes to some extent to the reduction of the flow resistance in the exhaust system. However, the substantial advantage of the arrangement is to be seen in the possibility of keeping the housing with the aid of simple means at lower temperatures corresponding to length variations which do not exceed the length variations in the catalyst body.

In accordance with a further development of the invention, the bearing members are designed as two-part members, one part being connected to the housing and the other part supporting the casing of the catalyst body, and an elastic ring is provided between the two bearing member parts. This ring is again advantageously received in a U-shaped seal ring. This arrangement has the advantage that the elastic ring and the U-shaped seal ring are mounted at locations which are not exposed to the high exhaust gas temperatures. The result is that the elastic system shows a better behavior at higher temperatures.

For an understanding of the principles of the invention, reference is made to the following description of typical embodiments thereof as illustrated in the accompanying drawings.

GENERAL DESCRIPTION OF THE PREFERRED EMBODIMENTS

Figure 1:
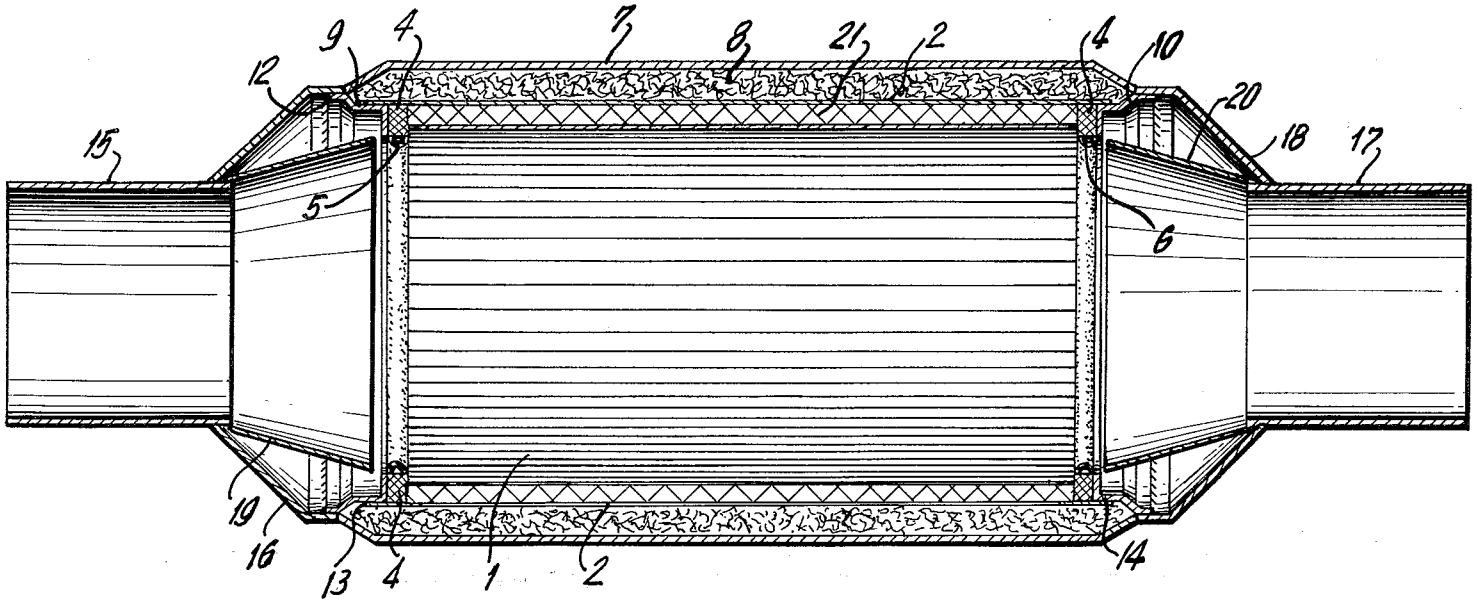
FIG. 1 is an axial sectional view of a device for the catalytic purification of the exhaust gases of an internal combustion engine constructed in accordance with the invention.

Referring to the drawings in particular the invention embodied therein in FIG. 1 comprises a tubular housing 7 which is connected at one end to an exhaust gas supply pipe 15 and at an opposite end to an exhaust gas discharge pipe 17. The gases which pass through the housing pass into and through passages of a monolithic honeycomb or catalyst carrier 1 which is arranged in accordance with the invention inside a tubular casing 2 which is arranged within and spaced interiorly of the interior of the housing 7.

In the embodiment shown the supply pipe 15 and the discharge pipe 17 are connected to the tubular housing 7 through transition pieces 16 and 18 respectively which provide walls which converge from the larger diameter housing 7 to the smaller diameter pipes 15 and 17.

In accordance with one aspect of the invention the the catalyst carrier 1 is supported on an elastic mesh material or compacted metal mesh 21 which is disposed radially between the inner wall of the casing 2 and the wall of the catalyst carrier 1. The casing 2 which has to absorb the radial stresses advantageously comprises an annular body which has one or more longitudinally extending slits therein, and variations of radial stressing can be absorbed in accordance with the width of the slits. The slits are also advantageously designed so as to prevent any squeezing of portions of the elastic material 21, and for this purpose the casing 2 may be designed as a longitudinally slit annular body having overlapping end portions in the form of a wound body.

Figure 3:
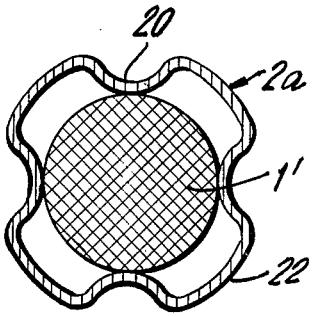
FIG. 3 is a cross-sectional view on a reduced scale indicating a still further embodiment of the invention.

In the embodiment shown in FIG. 3 a suitable casing **2*a* advantageously comprises a plurality of indented areas 20 and raised areas 22. The casing 2*a* would advantageously be made of springy material so as to form a resilient support between the catalyst carrier body 1' and the interior of the tubular housing 7. The casing 2 is of a construction chosen to permit absorption of radial variations in dimension as well as axial variations caused by exposure to the hot gases. In the embodiment shown in FIG. 3, the elastic material 21 may be included only in the indented areas 20** for example or may be even omitted in some cases.

In the annular space between the casing 2 and the housing 7 a thermal insulation 8 is placed and it may advantageously comprise a mat of ceramic fibers. This insulating layer can protect the housing from an excessive heat caused by the exhaust gases in order to maintain the housing at temperatures below 200° C for example. At such a temperature the length variations of the housing due to thermal stresses correspond approximately to those of the catalyst body so that the fixing forces for the catalyzer are insured without endangering the catalyst carrier 1 and without permitting the catalyst carrier 1 to be loosely supported.

The casing 2 is supported on angle-shaped bearing members 9 and 10 at the respective ends which are connected to the housing 7. The connection may be permanent or detachable but in any case it must be able to transmit the fixing forces. Thus for example bearing member 9 located before the catalyzer in respect to the flow direction is advantageously connected to the housing 7 by a welding 12 while the other bearing member 10 at the opposite end may be screwed to the housing 7. Such a design is preferred in embodiments providing an interchangeable catalyst carrier 1.

Casing 2 may also be supported on bearing members 9 and 10 so that on one side the mounting is firm and at the other side for example the gas supply side there is a slide seat 13. This enables the casing which has a substantially higher temperature than the housing 7 to expand in the longitudinal direction without causing loosening of the catalyzer mounting.

Advantageously the slide seat 13 is provided before the catalyzer in the flow direction while the firm connection 14 is provided at the outlet side. In order to permit the absorption of length variations which cannot be compensated and which may occur any time since the temperature can never be adjusted in the desired manner and to also prevent a loosening of the catalyzer holding means, elastic rings 4 are provided between the bearing members 9 and 10 and the catalyst carrier 1. The bearing members 9 and 10 include an axially extending portion secured to the housing 7 and an axially extending portion defining respectively the slide seat 13 and the firm connection 14 to the casing 2. In addition each angle member includes a radially extending inner end portion which abuts against a side of ring 4. The rings 4 are advantageously made of a metal mesh or pre-compacted metal and they are surrounded on their inner faces by U-shaped section seals or sealings 5 and 6.

The seals 5 and 6 apply against the edge of the catalyst body and in particular prevent the passage of non-purified gases. Thus such gases are prevented from passing past the catalyzer body 1 around the periphery thereof and through the elastic material 21 or along the boundary layer between the catalyzer body 1 and the elastic material 21 into the discharge pipe 17 as an unpurified gas stream.

Figure 2:
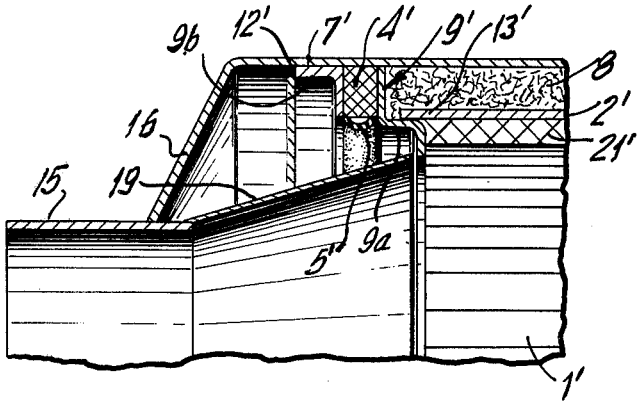
FIG. 2 is an enlarged partial sectional view similar to FIG. 1 of another embodiment of the invention.

The embodiment shown in FIG. 2 includes a bearing member 9' which is made up of two parts **9*a* and 9*b* with the part a being a double angle member and the part b being a single angle member. The double angle member 9*a* includes an inner flange abutting against an end of the elastic material 21' and the catalyst body 1' and its intermediate portion engages below the casing 2' and may be secured to the casing. The opposite end flange of the part 9*a* abuts against a resilient ring of compacted metal 4'. The body 9*b* has a flange abutting against the opposite side of the ring 4' and another flange which is welded to the interior of the casing 7'. A seal 5' extends between the two angle parts 9*a* and 9*b*** so that the entire connecting end joint is sealed.

In both the embodiment of FIGS. 1 and 2 connection pieces 19 and 20 are provided. They are intended as protection of the mounting system. The elastic ring 4' and the U-shaped cross section sealing 5' are protected by the plate 19 as seen particularly in FIG. 2. These transition plates 19 and 20 thus act as heat protection shields and also contribute to a uniform distribution of the hot exhaust gases entering the catalyzer body 1.

While specific embodiments of the invention have been shown and described in detail to illustrate the application of the principles of the invention, it will be understood that the invention may be embodied otherwise without departing from such principles.

What is claimed is:

1. A device for the catalytic purification of exhaust gases of internal combustion engines, comprising a tubular metal housing having an exhaust gas supply connection at one end and an exhaust gas discharge connection at an opposite end and defining a gas flow passage therethrough, a tubular casing of sheet metal within said housing and spaced radially inwardly from the interior walls thereof, a substantially cylindrical monolithic catalyst carrier disposed in the exhaust gas flow passage within said housing and spaced radially inwardly from said casing, said carrier having axially extending passages therethrough for the flow of exhaust gases therethrough, a radially prestressed compacted metal mesh disposed between said carrier and said casing and forming an elastic support for said carrier, annular bearing member means having a first axially extending portion fixedly connected to a respective end of said tubular housing, a second axially extending portion offset radially inwardly from said first axially extending portion and slidably supporting said casing thereon, said second axially extending portion having a radially extending portion forming an end abutment for axially supporting said carrier, an elastic seal ring disposed in said housing bearing against said radially extending portion of said bearing member means and a respective end of said carrier.

2. A device according to claim 1, wherein the space between said casing and said housing contains insulation.

3. A device according to claim 1, wherein said tubular housing has converging walled inlet and outlet transition parts at the respective ends and wherein said exhaust gas supply and discharge connections include respectively an exhaust gas supply pipe connected to one of said transition parts and an exhaust gas discharge pipe connected to the other of said transition parts, said pipes having protective shields extending axially inwardly into said tubular housing and terminating in widened end portions immediately adjacent to said catalyst carrier, whereby said shields protect said elastic seal ring from the heat of said exhaust gas.

4. A device according to claim 1, wherein said casing comprises a member having longitudinal slits therein.

5. A device for the catalytic purification of exhaust gases of internal combustion engines, comprising a tubular metal housing having an exhaust gas supply connection at one end and an exhaust gas discharge connection at an opposite end and defining a gas flow passage therethrough, a tubular casing of sheet metal within said housing and spaced radially inwardly from the interior walls thereof, a substantially cylindrical monolithic catalyst carrier disposed in the exhaust gas flow passage within said housing and spaced radially inwardly from said casing, said carrier having axially extending passages therethrough for the flow of exhaust gases therethrough, a layer of insulation disposed between said housing and said casing, a radially prestressed compacted metal mesh disposed between said carrier and said casing and forming an elastic support for said carrier, a first inner annular bearing member arranged at at least one end of said housing and having a first radially extending portion abutting an end of said layer of insulation, and having an axially extending first portion slidably supporting said casing and a second radially extending portion abutting against an end of said carrier, an elastic ring abutting against said first radially extending portion of said first annular member, a second annular member having a third radially extending portion abutting against the opposite end of said ring and a second axially extending portion fixedly secured to said tubular housing.

* * * * *